US005406440A

United States Patent [19]

Wieloch

[11] Patent Number: 5,406,440

[45] Date of Patent: Apr. 11, 1995

[54] SOFT-CLOSURE ELECTRICAL CONTACTOR

[75] Inventor: Christopher J. Wieloch, Waukesha County, Wis.

[73] Assignee: Allen-Bradley Company, Inc., Milwaukee, Wis.

[21] Appl. No.: 877,318

[22] Filed: May 1, 1992

[51] Int. Cl.[6] ..... H01H 47/22

[52] U.S. Cl. ..... 361/154; 361/160; 327/385

[58] Field of Search ..... 361/154, 186, 194, 203, 361/152, 153, 160, 170; 307/137, 542.1, 265; 324/420

[56] References Cited

U.S. PATENT DOCUMENTS 4,833,565 5/1989 Bauer et al. ..... 361/154

5,255,152 10/1993 Estes, III et al. ..... 361/160

*Primary Examiner*—A. D. Pellinen

*Assistant Examiner*—Richard T. Elms

*Attorney, Agent, or Firm*—John J. Horn; Mark Pfieffer; H. F. Hamann

[57] ABSTRACT

An electrical contactor including a control system for regulating the voltage applied to the contactor's coil. The control system is adapted for gradually increasing the applied voltage and the resultant current through the coil so that contact closure takes place under controlled conditions. The control system enables the contacts in the contactor to be closed with a minimum of contact bounce upon activation of the contactor.

9 Claims, 4 Drawing Sheets

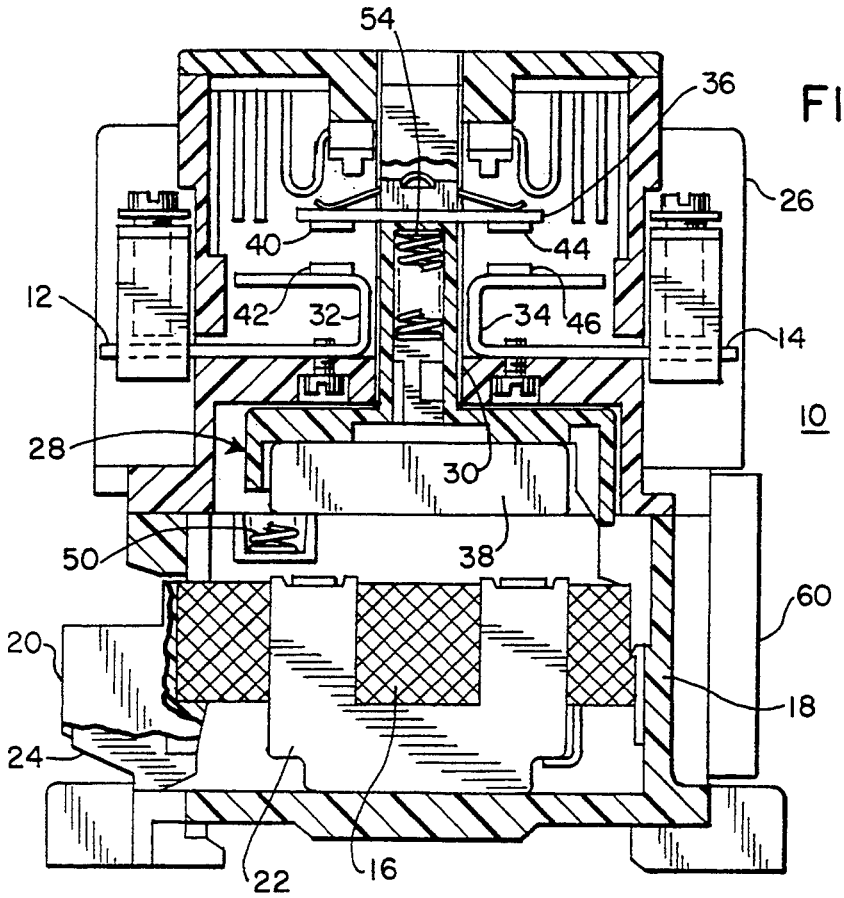
FIG. 1
FIG. 2
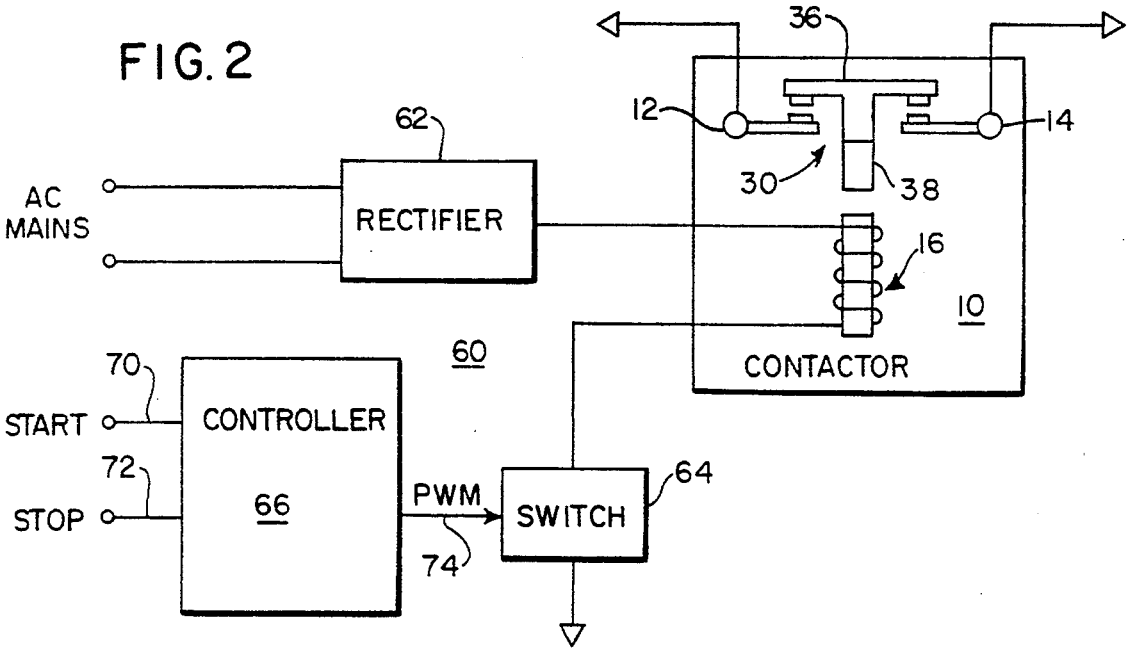

SOFT-CLOSURE ELECTRICAL CONTACTOR

BACKGROUND OF THE INVENTION

The present invention relates to electrical contactors and more particularly to electrical contactors in which the current within the contactor's coil or solenoid is controlled in order to reduce contact bounce during activation of the contactor and the wear which results from contact bounce.

In most conventional contactors the full amount of a rectified line voltage is applied to the coil or solenoid when activation of the contactor and closure of the contacts within the contactor is initiated. Consequently, the armature assembly on which the moving contacts are mounted rapidly accelerates and crashes into the stationary magnet which comprises the solenoid. The excess kinetic energy associated with this process results in multiple mechanical rebounds or "contact bounce" which may continue for 10–20 milliseconds or more and involve multiple contact openings and closings during each contactor activation event. Contact bounce leads to high levels of mechanical wear and erosion of the contacts due to repeated arcing.

In the past, some attempts have been made to control the contact closure process in electrical contactors. For example, U.S. Pat. No, 4,833,565 to Bauer et al discloses a system for sensing line voltage conditions and selecting preprogrammed profiles for phase angle modulating full wave format signals applied to the coil of a contactor so as to control the energy employed during the contact closure process. However, these techniques are relatively inflexible in responding to differences between individual contactors and operate in a highly discontinuous fashion with drive voltage being applied to the solenoid during only part of each half wave period of the line voltage signal.

It is therefore an object of the present invention to provide an electrical contactor with the capability of controlling the contact closure process in accordance with electrical conditions and in response to the characteristics of individual contactors.

It is a further object of the present invention to provide a system for automatically controlling the contact closure process in electrical contactors so that contact closure is achieved with a minimum of contact bounce and with reduced mechanical wear and electrical erosion of the contact elements.

It is another object of the present invention to provide a system for controlling contact bounce in electrical contactors which is economical to manufacture, reliable in operation and is of simple design.

SUMMARY OF THE INVENTION

The present invention constitutes an electrical contactor having a control capability for regulating the current used in driving the coil or solenoid within the contactor to provide for "soft" closure of the contacts within the contactor within a minimum of contact bounce. The present invention includes a rectifier for converting AC line signals to DC signals for use in driving the solenoid within the contactor, a transistor switch for controlling the voltage signal applied to the solenoid and a controller for regulating the operation of the transistor switch to control the process of contact closure.

In the preferred embodiment, the controller generates a pulse-width-modulated signal which is used to drive the transistor switch. The duty cycle of this pulse-width-modulated signal is increased linearly from a low duty cycle such as 20% to a high duty cycle such as 100% over a time interval which is adjusted to be at least several times the length of the average transition period for closure of the contacts in the contactor. The increasing duty cycle of the drive signal provided to the transistor switch results in increasing virtual voltage levels being applied to the solenoid. The increasing current flow through the solenoid due to the increasing virtual voltage eventually results in the armature within the contactor being pulled down toward the solenoid with the contacts being thereby closed. However, since the voltage and current applied to the solenoid are increasing in a graduated fashion, the voltages and currents supplied to the solenoid during the transition period for contact closure are limited to levels which are only slightly greater than the minimum levels required for activation of the contactor. Therefore, the contactor closes with a minimum of force resulting in reduced amounts of contact bounce, mechanical wear and electrical erosion.

BRIEF DESCRIPTION OF THE DRAWINGS

FIG. 1 provides a cross-sectional view of an IEC type contactor illustrating the basic structure and components of electrical contactors.

FIG. 2 provides a diagrammatic view of the overall system of the present invention.

DESCRIPTION OF THE PREFERRED EMBODIMENT

Figure 3:
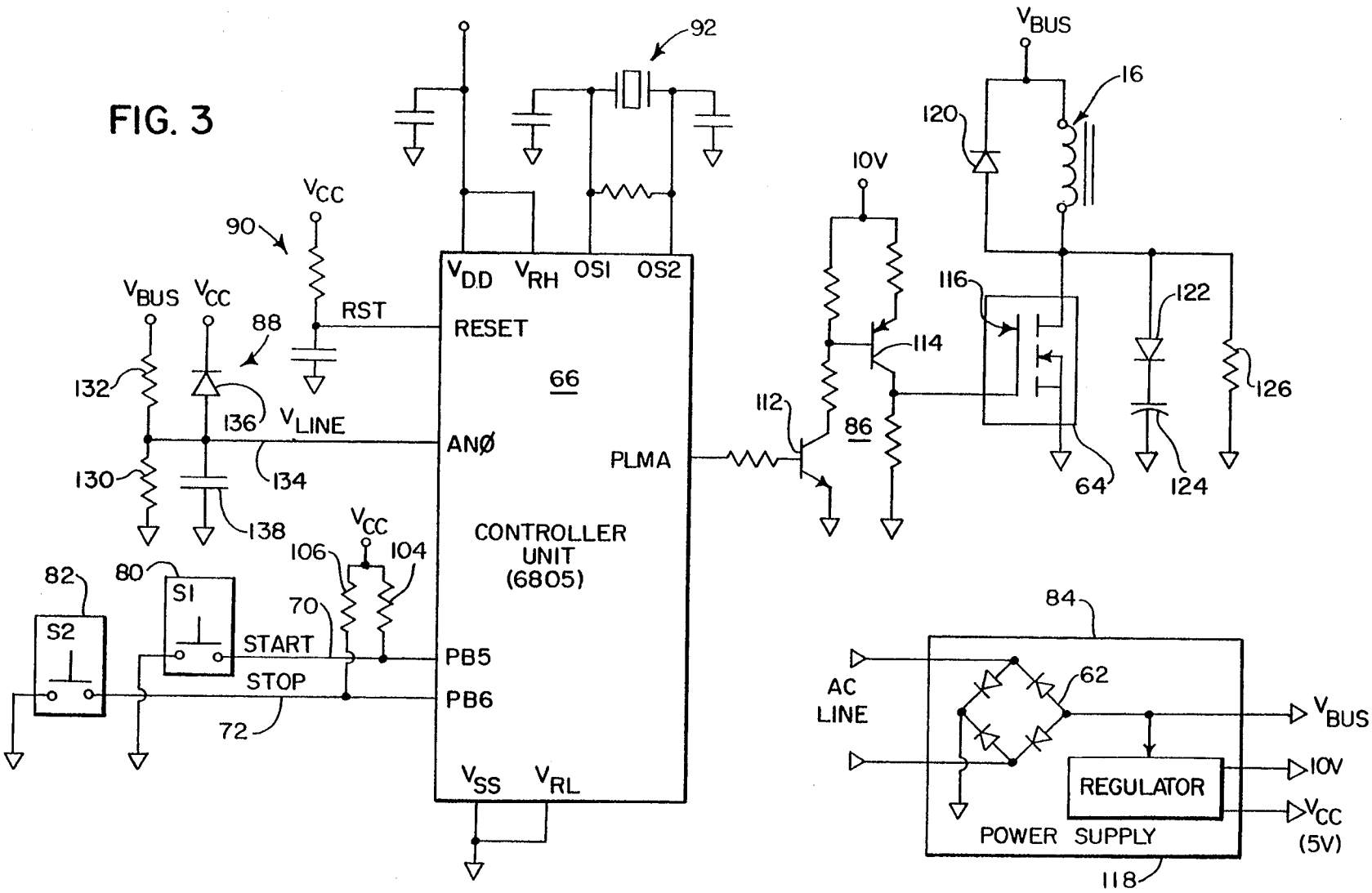
FIG. 3 provides a schematic diagram of the electrical components of the present invention.

Referring now to FIG. 1, a contactor 10 is shown for making and breaking electrical connectivity between the load terminals 12 and 14 in response to electrical signals applied to the solenoid 16. The contactor 10 includes a base 18 for mounting a removable tray 20 on which the solenoid 16 is mounted within a laminated iron yoke 22. During operation, the tray 20 is latched in position by the catch 24 with the solenoid 16 and the yoke 22 being centrally positioned within the base 18. The contactor 10 also includes a housing 26 secured onto the top of the base 18. An armature 28 is mounted within the housing 26 and includes a crossbar 30 positioned between the electrical leads 32 and 34 running to the load terminals 12 and 14. The crossbar 30 has a spanner 36 mounted at its top end above the leads 32 and 34 and a laminated iron slug 38 mounted at its bottom end above the solenoid 16 and yoke 22. Matching sets of electrical contacts 40 and 42 and 44 and 46 are mounted on the spanner 36 and the electrical leads 32 and 34, respectively. (It should be understood that the contactor 10 would ordinarily include three sets of electrical leads and contacts for controlling three phase AC signals).

The crossbar 30 is held upward in position by a pair of springs ( one of which is shown as spring 50, while the other spring is not shown) so that when the contactor 10 is not activated the contacts 40 and 44 are spaced apart from the contacts 42 and 46 (contacts open). However, when sufficient voltage is applied to the solenoid 16, the yoke 22 becomes magnetized and a magnetic field is generated which attracts the slug 38 connected to the crossbar 30. Given sufficient current within the solenoid 16 the slug 38 and crossbar 30 are pulled vertically downward (although in practice this direction might be sideways depending on the orientation of the contactor 10) against the urging of the pair of spring i.e. spring 50) to a position of mechanical contact with the yoke 22. Simultaneously, the spanner 36 is directed downward and the contacts 40 and 44 are driven down against the contacts 42 and 46, respectively. The contact spring 54 helps press the contacts 40, 44, 42 and 46 together after the slug 38 is drawn down against the yoke 22. The contactor 10 is thereby "activated" with electrical connectivity being established between the terminals 12 and 14 by physical contact between the contacts 40 and 44 and 42 and 46.

whenever it is desired to "inactivate" the contactor 10 and break electrical connectivity between the terminals 12 and 14 the flow of current within the solenoid 16 is discontinued. As the magnetic field subsides the crossbar 30 is immediately urged upward by the springs 50 and 52 and the slug 38 is translated away from the yoke 22 while the spanner 36 and the contacts 40 and 44 are spaced apart from the leads 32 and 34 and the contacts 42 and 46.

In the present invention the contactor 10 includes an electrical module 60 for controlling the voltage applied to and the resulting current flowing within the solenoid 16 so that the contact closure process for the contactor 10 is regulated to maximize performance and minimize wear. Referring now to Figure 2, the electrical module 60 includes a rectifier 62 for converting AC mains signals into single phase full wave DC signals which may be applied to the solenoid 16 whenever the transistor switch 64 is closed. The operation of the switch 64 is regulated by a drive signal supplied from the controller 66 on the line 74 in response to start and stop signals provided on the lines 70 and 72. The signals provided by the controller 66 to the switch 64 are comprised of large numbers of pulse-width-modulated pulses which are characterized during activation of the contactor 10 by linearly increasing duty cycles. The pulses control the current through the solenoid 16 to provide "soft" closure of the contacts 40 and 44 and 42 and 46 in the contactor 10.

Referring now to FIG. 3, the electrical components required for implementing the present invention are shown as including the solenoid 16, controller unit 66, transistor switch 64, pushbutton switches 80 and 82 and a power supply 84 including the rectifier 62. The present invention also includes a level shifting circuit 86, a line voltage sensing circuit 88, a reset circuit 90 and a crystal/ceramic resonator circuit 92. The pushbutton switches 80 and 82 are manually operable for connecting the lines 70 and 72 to ground and pulling the inputs PB5 and PB6 of the controller unit 66 from high to low voltage levels due to the action of the resistors 104 and 106. Start and stop signals for operation of the contactor 10 are thereby provided to the controller unit 66 whenever the pushbuttons 80 and 82 are pressed. The controller unit 66 provides an output signal for regulating the operation of the solenoid 16 on its output PLMA which is directed through the level shifting circuit 86 comprising the bipolar transistors 112 and 114 to the transistor switch 64. The level shifting circuit 86 converts the 5-volt signal from the controller unit 66 to a noninverted 10-volt signal suitable for driving the MOSFET transistor 116 of the switch 64.

The power supply 84 includes a diode ring rectifier 62 for use in converting an AC line signal to a DC signal $VBU_S$ which is directly used for driving the solenoid 16. The output of the rectifier 62 is also supplied to a voltage regulator 118 which in turn generates a stable 10-volt signal and a stable 5-volt signal $V_{CC}$.

One terminal of the solenoid 16 is connected to the power supply 84 for receiving the signal $V_{BUS}$ while the opposite terminal of the solenoid 16 is connected to the drain of the MOSFET 116. The source of the MOSFET is connected to ground while its gate is connected to the level shifting circuit 86 for receiving drive signals from the controller unit 66. Whenever the MOSFET 116 is turned on, the voltage signal $VBU_S$ is applied across the solenoid 16 and in response current flows through the solenoid 16 in accordance with the applied voltage. The diode 120 is operative after the switch 64 is turned off for providing a current discharge path between the terminals of the solenoid 16 as the magnetic field established as a result of previous current flow through the solenoid 16 is in the process of decaying. The diode 122 and capacitor 124 are functional for shunting any electrical noise arising from the rapid action of the transistor switch 64 to ground while the resistor 126 allows for intermittent discharge of the capacitor 124.

The line voltage sensing circuit 88 includes a voltage divider comprised of the resistors 130 and 132 which generate an appropriately scaled signal VLINE indicative of line voltage which is applied along the line 134 to the input AN0 of the controller unit 66. The diode 136 clamps the line 134 at the level of the supply voltage signal $V_{CC}$ while the capacitor 138 helps shunt any noise in the signal $V_{BUS}$ to ground. The controller unit 66 is responsive to the signal VLINE for blocking operation of the contactor 10 whenever the signal $V_{BUS}$ falls below design limits to a level too low for reliable operation. For example, whenever the average value of the signal $V_{BUS}$, which should normally be in the range of 105 to 130 volts, falls below 60 volts the controller unit 66 will then ignore further start signals provided from the pushbutton switch 80. The reset circuit 90 provides a delay in resetting the controller unit 66 upon power up of the system in order to allow the operation of power supply 84 to become stabilized. The crystal/ceramic resonator circuit 92 provides a clocking signal to the controller unit 66 at a frequency such as 4 MHz which governs the operation of the processor within the controller unit 66. The controller unit 66 preferably comprises a microprocessor system having pulse-width modulation capability such as the MC68HC05B4 8-bit microcontroller unit produced by Motorola, Inc. of Phoenix, Ariz.

In operation, the controller unit 66 responds to a start signal applied to the input PB5 as a result of the pushbutton 80 being closed by executing a program stored in digital memory. In accordance with the program a pulse-width-modulated signal having a comparatively high frequency such as 2 KHz is provided on the output PLMA for driving the switch 64. The widths of the pulses making up the signal are gradually increased in order to correspondingly increase the "virtual" (average) voltage applied to the solenoid 16 in accordance with the level of the supply signal $V_{BUS}$. When a sufficient current level is produced within the solenoid 16 as a function of the applied voltage, the contactor 10 is activated as the armature 30 is pulled downward and the contacts are closed so as to establish electrical connectivity between the load terminals 12 and 14 on the contactor 10. The widths of the pulses generated by the controller unit 66 continue to increase until a 100% duty cycle is reached. The duty cycle is then maintained at 100% for a fixed interval sufficient to allow the contact closure process to be fully completed even if begun at or shortly before time $T_3$. Thereafter, the controller unit 66 adjusts the drive signal to the switch 64 to have a lower duty cycle in order to provide for a lower level of current flow through the solenoid 16 which is nevertheless sufficient to maintain the contactor 10 in its activated condition with its contacts closed. When the controller unit 66 receives a stop signal at its input PB6 as a result of the pushbutton switch 82 being closed, the controller unit 66 stops generating further pulses for supply to the switch 64 thereby discontinuing the driving force for the flow of current through the solenoid 16. The armature 30 of the contactor 10 is forced upward and the contacts 40 and 44 and 42 and 46 are forced apart with electrical connectivity between the load terminals 12 and 14 being broken.

Figure 4:
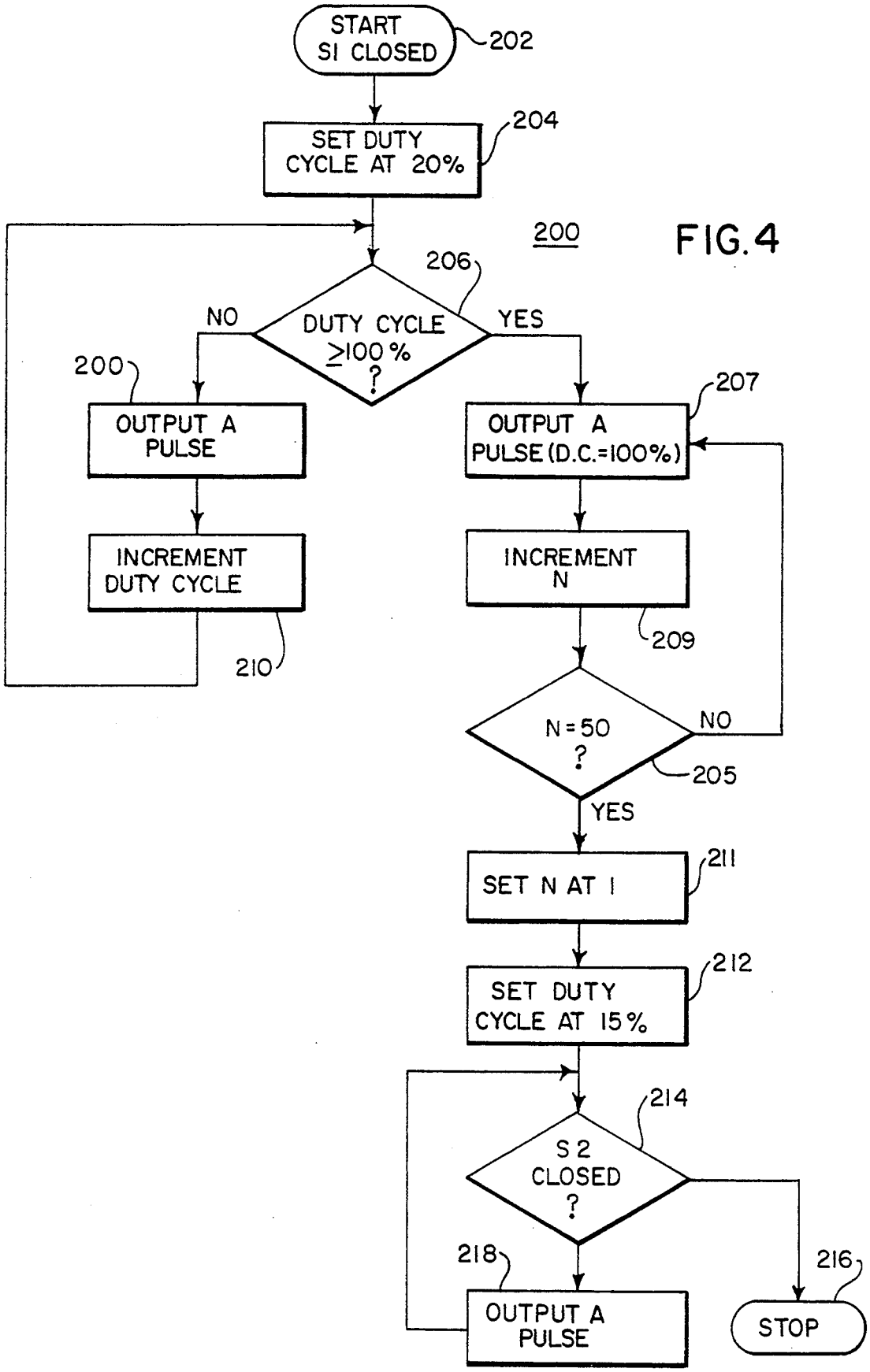
FIG. 4 provides a flowchart of the microprocessor program executed by the controller unit of the present invention.

Referring now to FIG. 4, a flow chart is shown for the program 200 executed by the controller unit 66 in response to a start signal from the pushbutton switch 80. After the pushbutton switch 80 is closed as shown in Step 202 the program 200 proceeds to Step 204 and sets the duty cycle for the pulses provided to the switch 64 at 20%. In accordance with Step 206 the program then determines whether the duty cycle is set to a value greater than or equal to 100%. If the duty cycle is not greater than or equal to 100%, the controller unit 66 outputs a pulse in Step 208 corresponding to the present value of the duty cycle. After a pulse is output the duty cycle is incremented by a fixed amount such as 0.4% in Step 210. The program 200 then loops back to Step 206.

If the duty cycle is greater than or equal to 100%, the program 200 proceeds from Step 206 to Step 207 at which the controller unit 66 outputs a pulse to the switch 64 with a duty cycle equal to 100%. The program 200 then proceeds to Step 209 in which it increments a count value N by 1 and passes to Step 205 in which the program inquires whether or not the count value is equal to a fixed number such as 50. If the count value is not yet equal to 50 the program 200 loops back to Step 207 and outputs another pulse. Steps 207, 209 and 205 provide a "dwell" period at 100% duty cycle approximately equal to the expected transition time $T_2$-$T_1$ for the contactor 10. If on the other hand the count value N is equal to 50, the program goes to Step 211 at which the count value N is reset to a value of 1. In Step 214 the program 200 proceeds to Step 212 at which the duty cycle for the pulses provided to the switch. 64 is set at 15%. The program 200 then inquires whether or not the pushbutton switch 82 is closed. If the switch 82 is closed the program 200 then terminates at Step 216. If the switch 82 is not closed the controller unit 66 outputs a pulse to the switch 64 with a duty cycle corresponding to the present value (15%) of the duty cycle and the program 200 loops back to Step 214.

Figure 5:
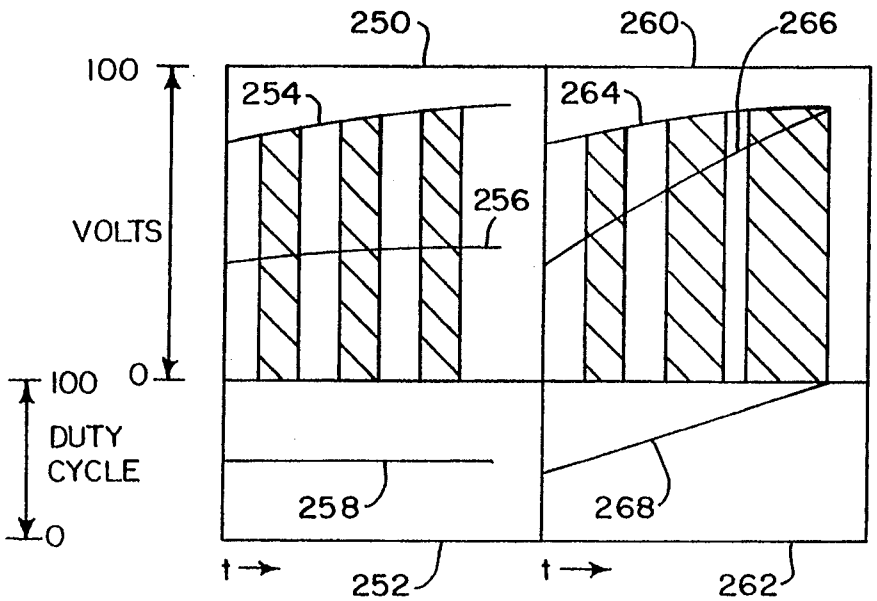
FIG. 5 provides a pair of graphical illustrations which are explanatory of the pulse-width modulation techniques employed in the present invention.

Referring now to FIG. 5, two graphs 250 and 260 are shown of pulse-width-modulated voltage signals as they might be applied to the solenoid 16. The graphs 252 and 262 show corresponding changes in the duty cycles of the signals illustrated in graphs 250 and 260. As shown in graph 250, three pulses having voltage levels determined by the line voltage curve 254 are generating a virtual voltage level represented by curve 256. Since the line voltage is gradually increasing, the virtual voltage is also increasing even though the duty cycle shown as line 258 in graph 252 is being held constant. As shown in graph 260, three pulses having voltage levels determined by the line voltage curve 264 are generating a virtual voltage level represented by curve 266. However, since the duty cycle shown by curve 268 in graph 262 is rapidly increasing, the virtual voltage level shown by curve 266 is also rapidly increasing and approaching the line voltage level as the duty cycle approaches 100%. Graphs 250 and 260 are intended to be explanatory of the general functionality of the drive pulses applied to the solenoid 16 and the effects of duty cycle variations on the operation of the present invention.

Figure 6:
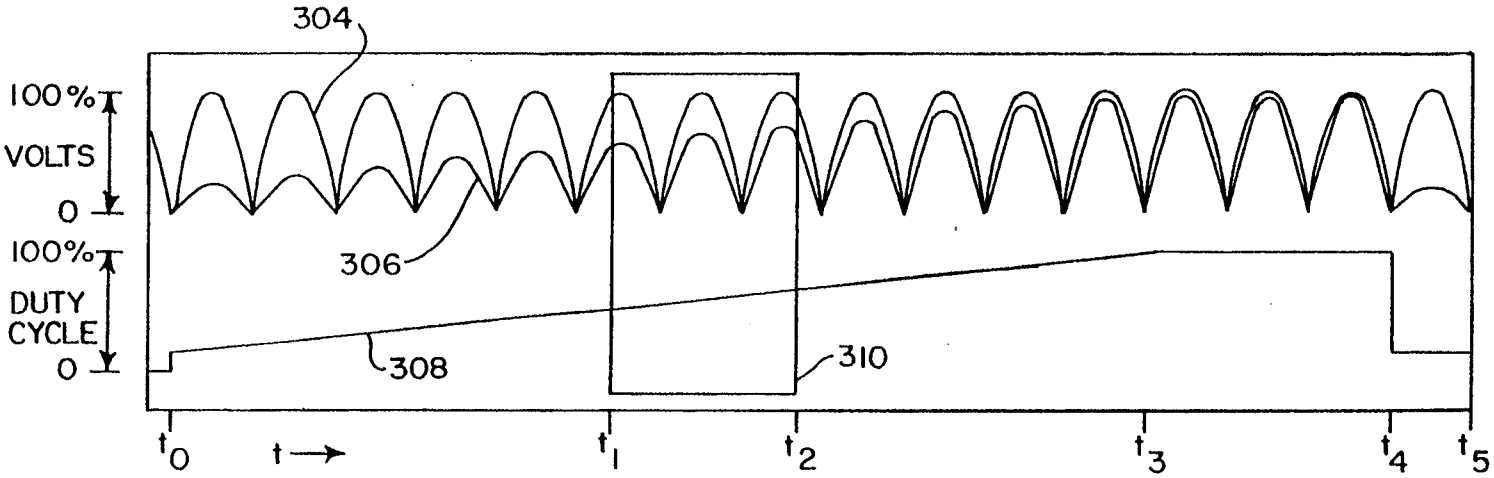
FIG. 6 provides a timing diagram showing the waveforms of the primary electrical signals which are characteristic of the present invention.

Referring now to FIG. 6, the operation of the present invention is illustrated in terms of waveform diagrams of electrical quantities critical to the operation of the invention over time period $T_0$ to $T_5$ during which the contactor 10 is activated and its contacts are closed. The waveforms 304 and 306 represent the rectified line voltage referred to as signal $V_{BUS}$ and the virtual voltage as applied to the solenoid 16 as a result of the switching action of the transistor switch 64. Waveform 308 represents the duty cycle of the pulse-width modulated signal applied to the transistor switch 64 for controlling the voltage and current of the solenoid 16. When the pushbutton switch 80 is closed, the controller unit 66 begins execution of the program 200 at time $T_0$. The period $T_0$ to $T_5$ covers approximately 133 milliseconds during which approximately 266 pulses are generated by the controller unit 66 and passed to the transistor switch 64. It should be noted that on account of the large number of individual pulses involved, the pulses themselves and the short term variations in voltage resulting from their individual action are not shown in the waveforms 304 and 306.

The duty cycles of the pulses supplied to the transistor switch 64 are gradually increased in a linear fashion as shown by the waveform 308 from a starting value of 20% duty cycle to an ending value of 100% duty cycle (In actuality the duty cycle increases in a step wise fashion with each pulse representing something like a 0.4% increase in duty cycle). In accordance with program 200, 100% duty cycle is reached at time $T_3$ and maintained over a fixed "dwell" period until time $T_4$ when the duty cycle value is immediately cut back to 15% whereby the contactor 10 can be held in its activated position while energy is conserved.

As the duty cycle gradually increases, the virtual voltage correspondingly increases although the virtual voltage shown by waveform 306 continues to also track the periodic changes (halfwave variations) in the line voltage represented by waveform 304. At time $T_3$ the virtual voltage is approximately equal to the line voltage as the duty cycle approaches 100%. As a result of the virtual voltage being applied to the solenoid 16, a current is induced in the solenoid 16 which gradually increases in value from time $T_0$ to time $T_3$. It should be noted that the current generally follows a ramp function but changes in the current may not be strictly monotonic on account of the periodic variations in the line and virtual voltages. At the time $T_4$ the virtual voltage drops back to approximately 15% of the line voltage while the current decays to a value on average equal to 15% of its value at time $T_3$.

In accordance with the individual characteristics of the contactor 10, at some time $T_1$ between time $T_0$ and time $T_3$ sufficient current flows though the solenoid 16 to pull the armature 30 down into proximity with solenoid 16 and activate the contactor 10 by closing the contacts 40, 42, 44, and 46. However, a certain finite period of time is necessary for the armature 30 to move from its up position to its down position as represented by the transition period 310 extending between times $T_1$ and $T_2$. The transition period 310 typically extends over an interval of approximately ten to twenty-five milliseconds and typically begins at the point when the virtual voltage reaches approximately 75 volts. However, it should be noted that on account of variations in line voltage (which can ordinarily range between 105 and 130 volts) and on account of variations in the operational characteristics of the contactor 10, the exact point at which the required voltage for activating the contactor 10 may be reached is indeterminate. It is an advantage of the present invention that this point is always reached at some time between times $T_0$ and $T_3$ provided the system is operating within design limits. The appropriate "activation" voltage is obtained at one point or another as the duty cycle of the pulses driving the transistor switch 64 is increased regardless of the individual characteristics of the contactor 10 or the exact level of the line voltage.

Furthermore, the amount of current flowing through the solenoid 16 during the transition period 310 is limited by the slope of the duty cycle waveform 308 which governs the level of the virtual voltage so that just enough but not too much current is available to activate the contactor 10 and close its contacts. Therefore, the armature 30 of the contactor 10 is moved from its up to its down position with very little extra current being supplied during the transition period 310 and with a minimum of force being used. This technique results in a dramatically reduced contact bounce effects and a substantially lesser amount of wear on the contacts. The increase in the duty cycle from $T_1$ to $T_2$ and the increase in the level of the virtual voltage is preferred to be in the range of approximately 15%–20%. However, it should be noted that these figures are dependent upon the size and characteristics of the contactor and the level of the line voltage which affect the length of the transistion period. Furthermore, it is believed that increases in voltage and current of this magnitude during the transition period 310 actually help in overcoming the increased spring resistance during the progressive movement of the armature 30 without resulting in substantial increases in the velocity of the armature 30 beyond the minimum energy level necessary to activate the contactor 10.

While particular embodiments of the present invention have been shown and described, it should be clear that changes and modifications may be made to such embodiments without departing from the true scope and spirit of the invention. It is intended that the appended claims cover all such changes and modifications.

I claim:

1. In an electrical contactor having a solenoid for controlling the movement of an armature which is affixed to a contact spanner adapted for making electrical contact between one or more pairs of electrical terminals in response to the movement of said armature during a pull-in cycle from an armature deactivated position to an armature activated position, the improvement comprising:

means for applying an energizing signal having a first predetermined magnitude at a starting time of each pull-in cycle;

means for steadily increasing the of the energizing signal after said starting time of the pull-in cycle, including high frequency pulse width modulation means for generating voltage pulses and steadily increasing the duty cycles of said pulses in order to increase said energizing signal at a substantially uniform rate between said first predetermined magnitude and a second predetermined magnitude greater than said first predetermined magnitude;

means for determining a second time in said pull-in cycle after said starting time at which the magnitude of the energizing signal has been increased to at least said second predetermined magnitude;

means for maintaining the energizing signal at said second predetermined magnitude at said second time and thereafter for an additional predetermined period of time, said additional predetermined period of time being sufficient for said contact spanner to establish contact between said pairs of electrical terminals, thereby completing the pull-in cycle; and means for reducing the energizing signal to a third predetermined magnitude after said additional predetermined period of time has elapsed, said third predetermined magnitude being sufficient to hold said armature in position with electrical contact continuing between said pairs of electrical terminals.

2. The improvement of claim 1, wherein said high frequency pulse width modulation means operates at a frequency of approximately 2 KHz.

3. The improvement of claim 1, wherein said means for increasing said energizing signal is adapted for increasing said energizing signal by an amount in the range of approximately 15–20 percent over a transition period during which said armature is in motion from said deactivated position to said activated position.

4. The improvement of claim 1 in which said duty cycle is increased by a fixed amount for each successive voltage pulse generated, wherein a plurality of different and unique voltage pulse widths of steadily increasing duty cycle are generated between said first predetermined magnitude and said second predetermined magnitude.

5. The improvement of claim 1 in which said duty cycle is increased from a 20% duty cycle corresponding to said first predetermined magnitude to a duty cycle of 100% corresponding to said second predetermined magnitude.

6. An electrical contactor, comprising:

one or more electrical contacts attached to a movable armature, the armature being held in a retracted position by a biasing force and being movable to an engaged position, in which said electrical contacts alternate between open and closed conduction conditions responsive to movement of said armature:

a solenoid for controlling movement of said armature between said retracted and engaged positions in response to an applied voltage; and means for controlling current flowing through said solenoid by increasing said applied voltage at a substantially uniform rate over a soft closure time interval, in which the applied voltage has a relatively lower magnitude at the beginning of the soft closure time interval and is steadily increased to successively higher relative magnitudes, such that the movement of said armature begins at a time in the soft closure interval at which the applied voltage reaches a magnitude which is minimally sufficient to cause said solenoid to overcome said biasing force on said armature and thus initiate armature movement at a minimum magnitude of applied voltage, wherein said means for controlling current includes means for controlling the widths of a plurality of high frequency voltage pulses applied to said solenoid by increasing said widths at a substantially uniform rate in order to increase said current at a substantially uniform rate whereby the applied voltage applied to said solenoid is also increased at a substantially uniform rate.

7. The electrical contactor of claim 6, wherein said means for controlling current is adapted for increasing said applied voltage by an amount in the range of approximately 15–20 percent between said time at which the applied voltage is minimally sufficient to initiate armature movement and a later time at which the armature has moved to said engaged position.

8. An electrical contactor, comprising: one or more electrical contacts attached to a movable armature, the armature being held in a retracted position by a biasing force and being movable to an engaged position, in which said electrical contacts alternate between open and closed conduction conditions responsive to movement of said armature a solenoid having first and second input terminals for making electrical connections to a solenoid coil which is adapted for driving said armature from said retracted position to said engaged position; and means for controlling current flowing through said solenoid coil including:

a voltage source having first and second output terminals, with the first output terminal being connected to said first input terminal of said solenoid, a transistor switch connected between said second output terminal of said voltage source and said second input terminal of said solenoid for regulating a virtual voltage level applied to said solenoid, and a controller connected to said transistor switch for generating a pulse-width-modulated signal adapted for controlling the operation of said switch on a duty cycle basis and thereby regulating the virtual voltage level applied to said solenoid, wherein said controller includes means for, steadily increasing the duty cycle of the pulse-width-modulated signal generated by said controller at a substantially uniform rate during a soft closure time interval of said contactor, said soft closure time interval including both a period before said armature initiates movement away from said retracted position and also a transition period during which said armature is in motion towards said engaged position.

9. The electrical contactor of claim 8, wherein said controller generates said pulse-width-modulated signal at a frequency of approximately 2 KHz.

* * * * *